United States Patent [19]

Duvlis

[11] 4,140,105

[45] Feb. 20, 1979

[54] GAS CURTAIN FOR SHIELDING PERSON ON AN OPERATING TABLE

[76] Inventor: Zinon Duvlis, Burgdorfer Damm 3, 3 Hannover, Fed. Rep. of Germany

[21] Appl. No.: 811,481

[22] Filed: Jun. 30, 1977

Related U.S. Application Data

[63] Continuation-in-part of Ser. No. 570,189, Apr. 21, 1975, abandoned, and Ser. No. 595,979, Jul. 14, 1975, abandoned.

[30] Foreign Application Priority Data

Dec. 4, 1973 [DE] Fed. Rep. of Germany ..... 2360234

[51] Int. Cl.[2] ..... A61G 13/00; F24F 9/00

[52] U.S. Cl. ..... 128/1 R; 128/139; 98/36; 55/DIG. 29; 422/120

[58] Field of Search ..... 128/1 R, 1 B, 145 R, 128/139, 132 R, 132 D; 21/74 R, 53; 98/36 R; 55/DIG. 29

[56] References Cited

U.S. PATENT DOCUMENTS

| | | | |
|---|---|---|---|
| 983,877 | 2/1911 | Cummings | 98/36 |
| 2,209,054 | 7/1940 | Doud et al. | 98/1 R |
| 3,068,775 | 12/1962 | Zehnder | 98/36 |
| 3,107,863 | 10/1963 | Potapenko | 240/1.4 |
| 3,113,501 | 12/1963 | Cargo | 98/36 |
| 3,207,056 | 9/1965 | Flebu | 98/36 |
| 3,239,305 | 3/1966 | Potapenko | 21/74 |
| 3,279,883 | 10/1966 | Thompson et al. | 21/53 |
| 3,380,369 | 4/1968 | Allander | 128/1 R |
| 3,385,036 | 5/1968 | Webb | 55/418 |
| 3,511,162 | 5/1970 | Truhan | 128/145 R X |
| 3,721,067 | 3/1973 | Agnew | 128/1 R |
| 3,724,172 | 4/1973 | Wood | 55/97 |
| 3,768,970 | 10/1973 | Malmin | 21/74 R |
| 3,776,121 | 12/1973 | Truhan | 98/33 R |
| 3,776,217 | 12/1973 | Galen et al. | 128/113 |
| 3,803,995 | 4/1974 | Allander | 98/36 |
| 3,820,536 | 6/1974 | Anspach, Jr. et al. | 128/132 R |
| 3,834,293 | 9/1974 | Danieli | 98/36 |
| 3,893,457 | 7/1975 | Vander Waaij | 128/132 R |
| 3,923,482 | 12/1975 | Knab et al. | 55/412 |

FOREIGN PATENT DOCUMENTS

| | | | |
|---|---|---|---|
| 440403 | 12/1935 | United Kingdom | 55/DIG. 29 |
| 481991 | 3/1938 | United Kingdom | 55/DIG. 29 |

*Primary Examiner*—Henry J. Recla
*Attorney, Agent, or Firm*—Michael J. Striker

[57] ABSTRACT

An operation area on an operating table is flanked by a blower unit and a suction unit. The blower unit creates several vertically spaced and independently adjustable streams of gas each of which is aspirated by a respective intake of the suction unit. The lowermost stream of gas, which is sterilized, flows just tangent to the operation location on the body of a patient lying on the operating table. The outlets of the blower unit and the intakes of the suction unit are independently adjustable to position the respective gas streams in accordance with the dimensions of the body part being shielded.

32 Claims, 6 Drawing Figures

FIG. 1
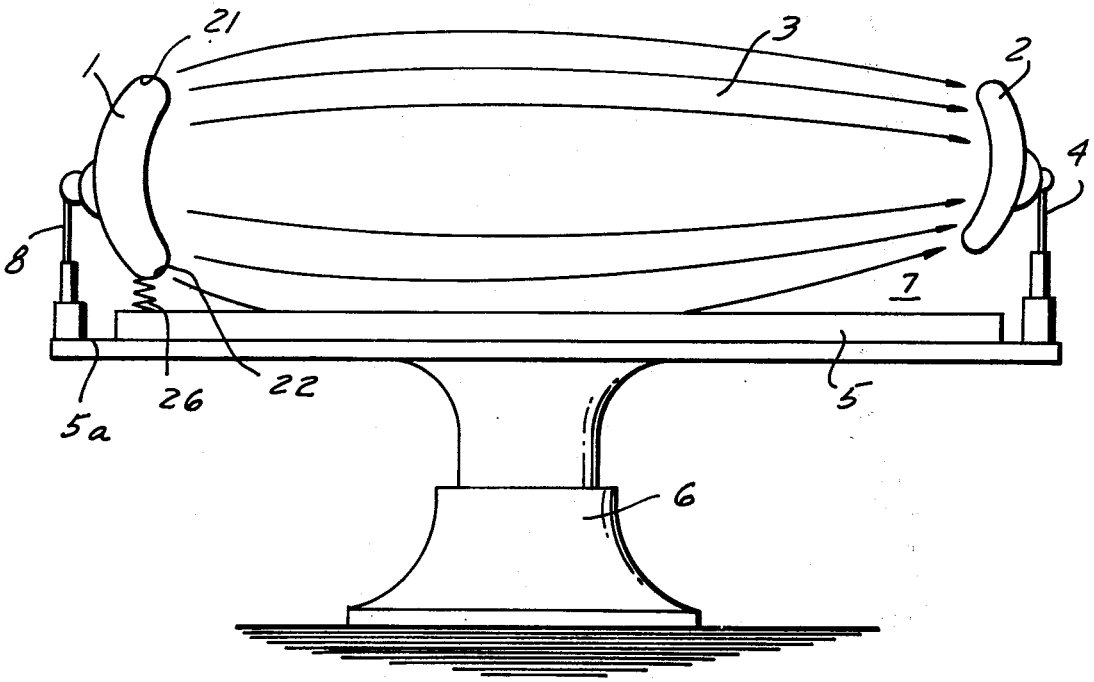
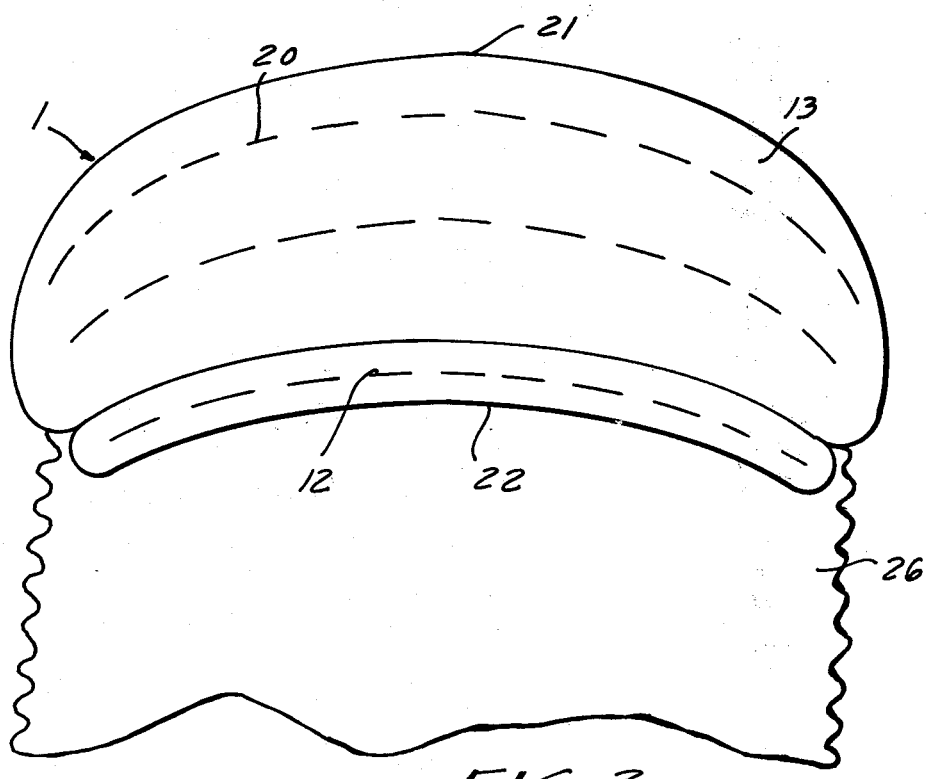
FIG. 2

FIG. 3
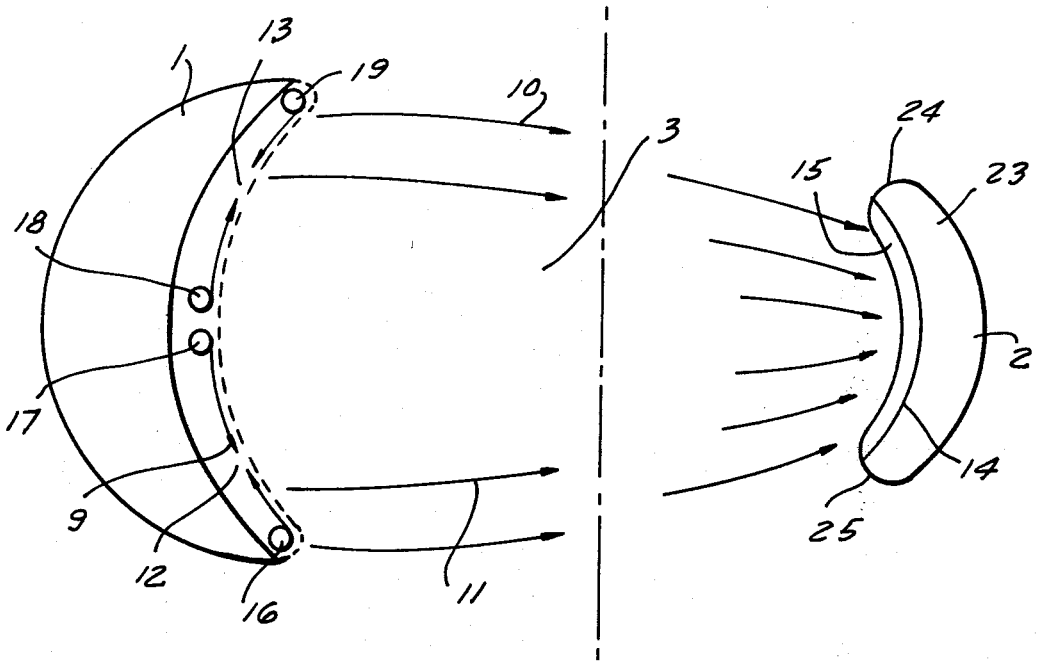
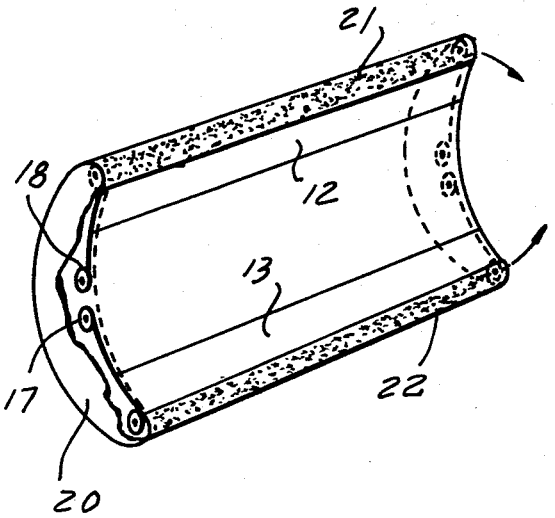
FIG. 4
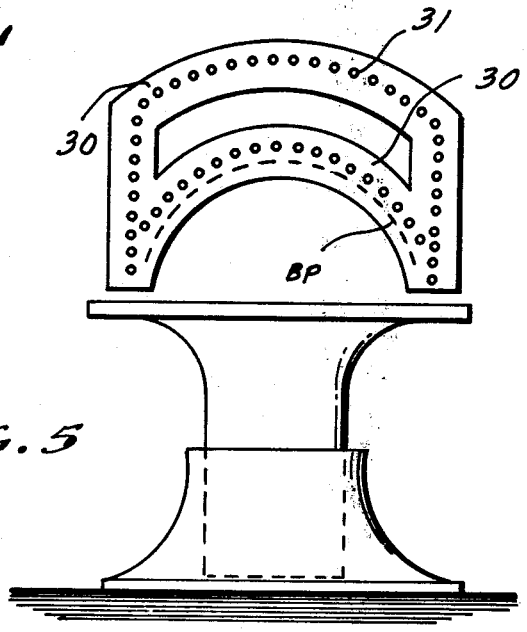
FIG. 5

GAS CURTAIN FOR SHIELDING PERSON ON AN OPERATING TABLE

CROSS-REFERENCE TO RELATED APPLICATIONS

This application is a continuation-in-part of my copending patent applications Ser. Nos. 570,189 and 595,979 filed 21 Apr. 1975 and 14 July 1975, respectively, both now abandoned, and is related to my copending application Ser. No. 667,012 filed 21 Jan. 1976, now U.S. Pat. No. 4,063,495. The disclosures of all of these applications are herewith fully incorporated by reference.

BACKGROUND OF THE INVENTION

The present invention relates to a method of and apparatus for shielding a patient during a medical operation. More particularly this invention concerns an operating table as well as a method of and apparatus for shielding a patient thereon from bacteria.

It is known to make attempts to protect areas of the type in question, for instance the area of an operating table, against entry of air-borne bacteria and other contaminants, such as dust and the like. For this purpose the air which has access to the area to be protected is filtered; nevertheless, experience has shown that while the quantity of contaminants that reaches the area to be protected can be reduced in this manner, it is not possible to completely preclude the entry of air-borne bacteria and other contaminants with this approach.

To this end it is known to install in an operating room a blower which directs a single stream of sterilized air above and across the platform of the operating table so that the stream of sterilized air prevents germs in the surrounding area from reaching the patient resting on the platform in the course of an operation or other type of treatment. Such mode of shielding the patient is quite satisfactory as long as the air stream is not interrupted, for example, by the hand(s) and/or arm(s) of the surgeon and/or his or her assistant(s). Once the air stream is interrupted, germs from the surrounding atmosphere can penetrate into the area above the platform of the operating table. Since the air stream is most likely to be interrupted in the region where the surgeon makes an incision or removes bandages from an unhealed wound, the aforedescribed equipment cannot prevent bacteria and/or other germs from reaching and eventually infecting the wound.

SUMMARY OF THE INVENTION

It is therefore an object of the present invention to provide an improved method of and apparatus for shielding a patient from bacteria during a medical operation.

Another object is the provision of an improved gas curtain for an operating table.

In keeping with these objects, and with others which will become apparent hereafter, one aspect of the invention resides in an arrangement for preventing access of bacteria and other contaminants to an area in which medical operations are carried out. Briefly stated, this arrangement comprises first means for producing a stream of sterile gas, and second means for directing the stream tangentially over the area to form a gas curtain which prevents access of contaminants to the area.

It is currently preferred if the first means for producing the gas stream has a substantially tubular housing, and if the second means comprises a longitudinal slot formed in the tubular housing and through which the gas stream is expelled. The gas stream therefore exits from the tubular housing through the slot transversely to the elongation of the housing, and can be directed in any desired direction tangentially of the area to be protected, by properly orienting and/or otherwise influencing the slot.

More specifically, the improved apparatus comprises basically a source of sterilized air which has means for discharging several discrete streams (e.g., wide but thin layers) of sterilized air across the platform of an operating table so that the air streams travel along paths which overlie, at least in part, the patient-receiving area above the platform. Thus, and since the source can furnish at least two discrete air streams, the likelihood of penetration of germs from the surrounding atmosphere into the area occupied by a patient is very remote because at least one of the air streams remains effective even if the other air stream or streams are interrupted by the hands, arms and/or torso of a surgeon, his nurse or assistant, and/or by implements in the hands of such persons. The source is preferably supported in such a way that it is located outside of the area which is to be occupied by a patient on the platform of the operating table.

The apparatus may further comprise a suction head or analogous means for collecting the air streams opposite the source. The source and/or the suction head may comprise adjusting means which enable the person in charge to change the size, shape, position and/or orientation of openings through which the air streams issue from the source and/or of openings which are provided in the suction head to collect the air streams.

The casing of the source and/or the housing of the suction head may consist of deformable material or may be assembled of articulately connected components to allow for additional adjustment of the position, size, shape and/or orientation of the respective openings. Also, the casing and/or the housing may be assembled of rigid or deformable but preferably interchangeable modules which are provided with openings (e.g., orifices of nozzles in the source) from which streams of sterilized air issue and/or which collect streams of air supplied by the source.

The air streams (there may be three or more air streams) form a labyrinth seal around an object which enters their path. The resulting turbulence promotes the entry of germs into the path of uninterrupted stream or streams.

The novel features which are considered as characteristic for the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWING

FIG. 1 is a schematic elevational view of an operating table and of an apparatus which embodies one form of the invention;

FIG. 2 is a front elevational view of the blower, substantially as seen in the direction of arrow II in FIG. 1;

FIG. 3 is a plan view of the apparatus;

FIG. 4 is a perspective view of the casing of the blower; and

FIG. 5 is a front elevational view of a modular blower.

DESCRIPTION OF PREFERRED EMBODIMENTS

Figure 1A:
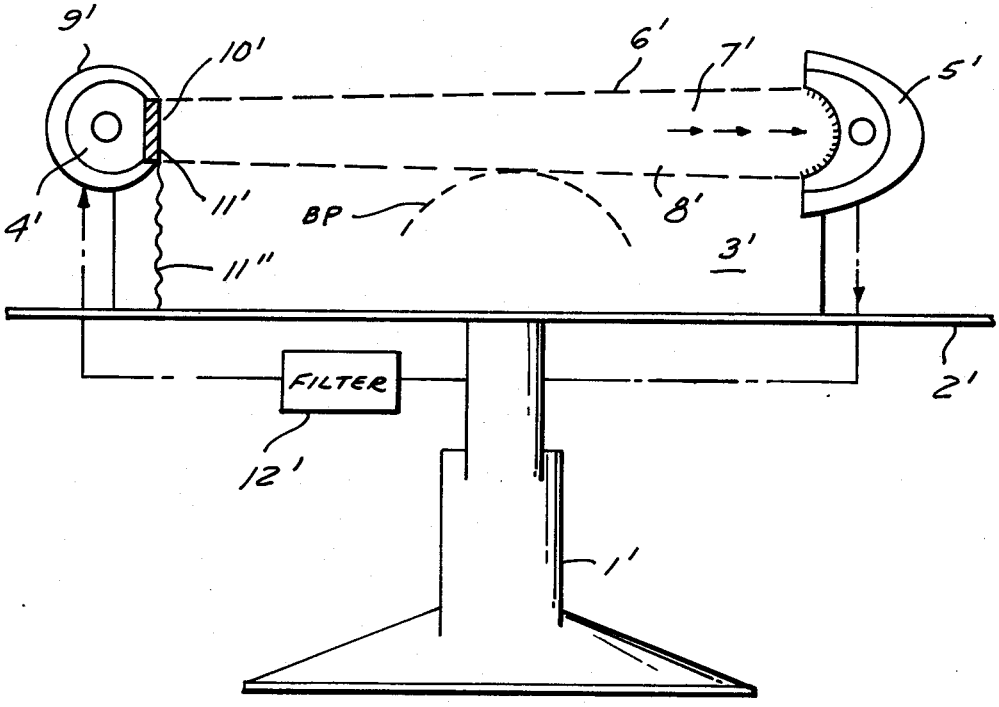
FIG. 1A is a diagrammatic illustration of the invention.

A base 1' of an operating table has a plate or top 2'. The area 3' above the top 2' is to be protected against access of bacteria and other contaminants, such as dust and the like, since it is in the area 3' that medical operations — surgery — will be performed here on a body part whose outline is indicated at BP. According to the present invention, a blower 4' is located at one side of the area 3' and at the opposite side thereof there is located a suction device 5'. The blower 4' produces a stream of sterile gas, usually air, and the suction device 5' serves to aspirate this stream, as indicated by the arrows.

It will be seen that the blower 4' has a tubular housing which is elongated in direction normal to the plane of the drawing and which will of course in the usual manner contain an arrangement for producing a stream of air. This arrangement is not shown because it is completely conventional and known to those skilled in the art. The tubular housing 9' has a longitudinally extending slot 10' that extends horizontally along its axis and from which the gas stream is expelled across the area 3', tangentially thereof, so as to form above the area 3' a protective curtain or barrier of gas that is identified with reference numeral 6' and which tangents the body part BP at the operation incision or wound. This gas is sterile, as already pointed out before, and prevents the passage of bacteria and other contaminants into the area 3', since any bacteria or other contaminants that enter from above or from the side into the flowing gas curtain 6' will be carried along by the same toward and into the aspirating or suction device 5.

It is advantageous if the curtain 6' is composed of a plurality of separate air flows or streams 7', 8' which flow essentially parallel to one another. This can be achieved by providing appropriate guide inserts or baffles 11' in the slot 10', which subdivide the outflowing gas stream to form the separate air flows or layers 7', 8'. These baffles 11' serve to direct the gas streams toward the suction device 5' over and tangentially of the body part BP in the area 3'. It will be appreciated that the gas curtain 6' should be adjustable to accommodate it to different configurations of the part BP, and these of course will depend upon the position and size of the patient and/or the particular operation to be performed. A filter 12' is provided in the return conduit from the suction unit 5' to the blower unit 4'.

In order to provide for such accommodation of the gas curtain 6' to the particular requirements, it is advantageous if the housing 9' is variable and deformable so that the slot or opening 10' concomitantly can be varied and deformed as to its shape and configuration and orientation, in order to be able to protect areas 3 of different sizes, shapes and contours with the sterile gas curtain 6'. Such variation is described below in more detail. In any case the lowermost sterilized gas stream flows just tangent to the operation site, not directly into the incision, but next to it so as to shield against entry of contaminants but do not dry it out.

The suction device 5 advantageously also is so constructed as to contribute to the desired conformation of the gas curtain 6'. In particular, it will be seen that the housing of the device 5' has an inlet opening which is so shaped that the marginal outer zones of the gas curtain 6' are subjected to particularly strong suction in the region of the projecting portions of the inlet of the device 5', in order to assure that there will be sharp edges formed on or in the gas curtain 6'.

The opening 10' of the housing 9' is itself variable and adjustable, which can be achieved by means of an adjustability of the baffles 11'. The housing 9' may be composed of a tubular element which may, for example have an axial length of 50 cm and which may be formed over a length of for example 36 cm with an axially extending slot forming the opening 10'.

Various ways of making the housing 9' and the opening 10' variable and deformable will be understood by those skilled in the art. It will also be appreciated that the devices 4' and 5' are both connected to a source of electrical energy, as diagrammatically indicated by the trailing electrical cord shown in connection with the device 4', and that the device 4' and 5' will both be mounted on supports as illustrated. They can be pivotably mounted on these supports, for example by means of ball and socket joints or the like, or in other ways well known to those skilled in the art.

Referring now to FIG. 1, there is shown an operating table having a pedestal or base 6 and a platform 5 which is mounted on the base and is located below an area 7 to be occupied by a patient. The improved apparatus comprises a blower 1 or an analogous source of sterilized air which is mounted on a plate 5*a* below the platform 5 at one end of the area 7, and an air collecting suction head 2 which is mounted on the plate 5*a* opposite the blower 1 so that the area 7 is disposed between 1 and 2.

The composite air stream, which issues from the blower 1 to shield a patient on the platform 5 from germs and is collected by the suction head 2, is shown at 3. In accordance with a feature of the invention, the composite air stream 3 consists of two or more vertically spaced discrete air streams including the streams 10 and 11 shown in FIG. 3. It will be noted that the path for the stream 11 is located between the area 7 and the path for the stream 10, i.e., the streams 10, 11 are disposed one above the other if the platform 5 is horizontal or nearly horizontal. The suction head 2 has a pipe or conduit 4 which serves for evacuation of collected air. This pipe 4 may be connected to the suction side of the blower 1 for recirculation of air above and across the area 7 subsequent to renewed sterilization.

The blower 1 is mounted on a support 8 (which preferably includes the pipe 5*b*) which is preferably adjustable with respect to the plate 5*a* so as to enable the person in charge to raise or lower the blower, to pivot the blower about a substantially vertical axis, to tilt the blower, to shift the blower at right angles to the plane of FIG. 1 and/or to otherwise change the position and/or orientation of air streams 10 and 11. The support 8A (which preferably including the pipe 4) for the suction head 2 may be constructed, mounted and manipulated in the same way as the support 8. As a rule, the blower 11 will be positioned in such a way that the streams 10, 11 issuing from its air discharging openings 12 and 13 (see FIG. 3) will travel along arcuate paths which are immediately or closely adjacent to the area 7. The suction head 2 is positioned in such a way that its intake opening or openings 15 receive the air streams 10, 11 irrespective of the selected position and/or orientation of the blower 1.

The size, shape and/or locus of the area 7 will often change from operation to operation. Such parameters depend on the nature of operation or treatment, on the age (and hence height) of the patient, and on the position a patient should occupy on the platform 5. Therefore, the adjustability of paths along which the air streams 10, 11 are caused to flow from the blower 1 to the suction head 2 is important and advantageous. As a rule, the paths of the streams 10 and 11 will be selected with a view to insure a substantially tangential flow of air with respect to the area 7 above the upper side of the platform 5.

The means for discharging several air streams from the casing 20 of the blower 1 toward the suction head 2 comprises several inserts 9 which determine the size, shape, position and/or orientation of the openings 12, 13. Similar inserts 14 are installed in the housing 23 of the suction head 2 to define a single intake opening 15 or two or more discrete intake openings for entry of air streams. The construction of the inserts 9 may but need not be identical with that of the insert or inserts 14. The arrangement may be such that the number of discrete intake openings 15 in the housing 23 equals the number or discrete air discharging openings in the blower 1. This insures that the streams 10 and 11 will travel along discrete paths all the way from the blower to the suction head, i.e., that the streams do not merge in the region between the openings 12, 13 and the intake openings of the suction head. If the surgeon happens to interrupt the upper or outer stream 10, the lower or inner stream 11 is likely to remain intact or vice versa. Consequently, any germs which penetrate into the space between the two air streams downstream of the obstruction in one of the streams are likely to enter the other stream and to be entrained into the suction head 2 to thus bypass the area 7. Also, the provision of means for focusing discrete air streams into the corresponding intake openings of the suction head 2 promotes turbulence in the region behind an obstruction in one of the air streams, i.e., the germs which can penetrate across the interrupted air stream enter a turbulent zone and are even more likely to enter the path of the uninterrupted air stream.

As shown in FIGS. 3 and 4, the insert 9 in the casing 20 of the blower 1 may comprise several flexible shades 12*a*, 12*b* and 13*a*, 13*b* which are respectively wound on rolls 16, 17 and 18, 19 and can be pulled off or wound up by the respective rolls in a manner resembling the manipulation of shades which are used in windows. For example, by causing or allowing the roll 16 to collect the shade 12*a* and by causing or allowing the roll 17 to pay out the shade 12*b*, the operator can shift the opening 12 toward the roll 16. By properly manipulating the shades 12*a*, 12*b*, the operator can also move the opening 12 toward the roll 17, reduce the width of the opening 12 and/or increase such width. The width of the opening 12 can be reduced to zero, for example, when the surgeon knows or assumes that the stream 10 will remain uninterrupted. The same applies for manipulation of the shades 13*a* and 13*b*. Each of the shades 12*a*–13*b* may consist of several discrete strips which can be manipulated independently of each other so that the user can change the length of the respective openings, as considered at right angles to the plane of FIG. 3, to thereby form narrower or wider air streams and/or to shift such air streams toward or away from the observer of FIG. 3. The marginal portions of the shades 12*a*–13*b* and/or their strips are preferably guided in suitable channels (not shown) which are provided therefor in the casing 20. If the openings 12, 13 are to be moved nearer to each other, i.e., nearer to the respective rolls 17 and 18, the shades 12*a*, 13*b* are withdrawn from the respective rolls 16, 19 and the shades 12*b*, 13*a* are wound up on the respective rolls 17, 18. As mentioned above, the width of openings 12, 13 can be regulated by changing the distance between the shades 12*a*, 12*b* and/or 13*a*, 13*b*. The construction of the insert 14 in the housing 23 of the suction head 2 may be identical with or analogous to that of the insert 9 (shades 12*a*–13*b* and rolls 16–19).

It is equally within the purview of the invention to replace the shades 12*a*–13*b* and rolls 16–19 by suitable blinds having slats which are adjustable in a number of ways to allow for closing or widening of openings 12, 13, to allow for changes in the width of such openings (as considered at right angles to the plane of FIG. 3) and/or to otherwise influence the size, position, configuration and/or orientation of the respective openings. The slats of the blinds can be mounted on cords in the same way as the slats of venetian blinds for windows or doors, i.e., the slats of a blind can be pivoted and/or shifted sideways. In addition, each blind can consist of two or more discrete blinds, the same as discussed above with the strips of the shades 12*a*–13*b*. It is also possible to employ blinds in the housing 23 and shades in the casing 20, or vice versa.

In certain instances, the suction head 2 should or may be provided with a single intake opening 15. The shades or blinds in the casing 23 are then manipulated with a view to insure the formation of one opening which receives all of the air streams.

In accordance with another feature of the invention, the entire casing 20 may consist of deformable material so that it can be flexed in several directions, to thereby further contribute to the ability of blower 1 to change the position, size, shape and/or orientation of openings from which the air streams issue to flow toward the suction head. The casing 20 has an upper marginal portion 21 with a convex outer side which flanks the opening 13 from above, and a lower marginal portion 22 which flanks the opening 12 from below. The configuration of the casing 23 may be selected so that it has a concave side facing the suction head 3 (see FIG. 3). This insures that the focussed streams 10, 11 converge toward each other in a direction from the respective openings 13, 12 toward the opening or openings 15 of the housing 23. Such configuration of the casing 20 further insures that the speed at which the streams of air flow above the area 7 is sufficient to entrain any and all germs which happen to penetrate into the path for the stream 10 and/or 11. By bending or deforming the casing 20, one can change the concavity of that side which faces the suction head 2 to thereby achieve a more or less pronounced focussing of the air streams.

In addition, the casing 20 can be flexed and deformed in other directions to thereby deform the marginal portions 22 and 21, especially if the insert 9 comprises several sets of rolls 16 – 19. Thus, and referring to FIG. 2, the casing 20 can be deformed so as to move the left-hand upright marginal portion 21*a* nearer to or further away from the right-hand upright marginal portion 22*a*. Such deformation renders it possible to form substantially roof-shaped streams which are even more likely to prevent penetration of germs into the area 7 above the platform 5. This will be desirable when the patient occupying the space 7 is short and his or her torso extends well above the upper side of the platform 5. The housing 23 is preferably deformable in the same way as the casing 20 to thus insure that the opening or openings 15 will invariably extend across the paths of the respective air streams. Also, the marginal portions 21*a*, 22*a* of the casing 20 can be pulled downwardly toward the plate 5*a* while the median zones of the marginal portions 21, 22 remain at the levels shown in FIG. 3. This further enhances the formation of relatively narrow roof-shaped air streams.

The upper and lower marginal portions 24, 25 of the housing 23 are shown in FIG. 3. These marginal portions can be deformed, shifted and/or otherwise oriented in the same way as described for the corresponding marginal portions 21, 22 of the casing 20. The casing 20 and/or housing 23 may consist of a ductile material or it may be assembled of several articulately joined parts to allow for afore-discussed flexing and deformation.

If desired, the insert 9 may comprise nozzles (not specifically shown) whose orifices constitute the openings 12 and 13. Such nozzles can be readily adjusted to insure proper concentration of air streams while such streams advance from the blower toward the suction head.

The speed of air streams is preferably adjustable. Such speed will be regulated in dependency on many factors, such as the position of the area 7 relative to the suction head 2 and/or blower 1 or the length of such area as considered in a direction from the blower toward the suction head. In accordance with the invention, the speed of each air stream is further adjustable independently of the other air stream or streams. Still further, it is possible to employ a composite source of sterilized air and composite collecting means for such air streams. For example, the one-piece source or blower 1 can be replaced with two sources one of which is mounted at one end and the other of which is mounted at the other end of the platform 5. The suction head 2 is then replaced by two discrete suction heads each of which collects air flowing from one of the two blowers. The just-mentioned modification is desirable when one of the air streams should flow countercurrent to the other stream. Moreover, such apparatus is even more likely to prevent the penetration of germs into the area 7 because the countercurrent streams will impinge against an arm or another obstruction from opposite sides to thereby insure that there is no room for penetration of germs below the dome-shaped or similarly configurated curtain of flowing sterilized air.

With reference to FIG. 3, the upper part of the structure indicated at 1 could constitute a blower and the lower part a suction head. Analogously, the upper part of the structure indicated at 2 could constitute a suction head and the lower part of a blower. The air stream 10 would then flow in a direction from 1 to 2 and the air stream 11 would flow from 2 to 1.

As mentioned above, the support 8 for the casing 20 and/or the support 8A for the housing 23 enables the user to move the blower 1 and/or the suction head 2 in a number of different directions, such as up and down, laterally (toward or away from the observer of FIG. 1), as well as about a vertical pivot axis. It is clear that the support 8 and/or 8A may be mounted on or simply stood on the floor so that such supports can be shifted independently of the operating table. This is especially desirable when the improved apparatus is to be used in combination with an existing operating table.

The lower marginal portion 22 of the casing 20 can be connected with a suitable shield or shroud 26 (shown in FIGS. 1 and 2) which extends to the upper sides of the platform 5 or plate 5*a* to prevent penetration of germs into the area 7 along the upper side of the platform, i.e., below the casing 20. The shroud 26 is preferably flexible so that it does not interfere with adjustment of the blower 1 relative to the platform 5, irrespective of whether the blower is lifted, lowered, moved sideways or pivoted.

Referring to FIG. 5, the blower 1 can be assembled of several arcuate, straight and/or otherwise configurated modules 30 (e.g., in the form of slabs) which are preferably interchangeable with each other and can be assembled or taken apart with little loss in time, depending on the desired configuration and inclination of air streams which flow toward the collecting means (not shown in FIG. 5). An advantage of modular construction of the source of sterilized air is that its modules can be sterilized in a much simpler way than a rather bulky one-piece blower. For example, the modules 30 shown in FIG. 5 can be separated from each other and individually sterilized in suitable autoclaves or the like. During assembly, the freshly sterilized modules are manipulated with sterilized towels or other sterilized textile material.

The modules may have air discharging openings which direct discrete streams of sterilized air toward the collecting means. By imparting to the modules 30 an appropriate shape and by providing each module with a large number of openings which can be individually sealed or opened, one can determine the direction and focussing of air streams issuing from each module with a high degree of accuracy and reproducibility.

In order to reduce the volume of air in the source including the modules 30 of FIG. 5, the openings for discharge of sterilized air may constitute the outlet openings of pipes 31 which are mounted on the modules. Each outlet opening may contain a suitable nozzle whose orifice then constitutes the discharging opening for sterilized air. The pipes 31 in each of the modules 30 can be placed so close to each other that the individual blasts of air issuing from the pipes of a given module together form a practically uninterrupted stream or curtain of sterilized air immediately downstream of the source. The pipes 31 may be made of flexible material so that the modules themselves need not be deformed at all if the person in charge wishes to change the direction of air flow from the pipes of a given module 30 toward the suction head.

The interchangeability of modules 30 contributes to versatility of the apparatus, i.e., the modules can be assembled to form blowers of many different sizes and shapes. In order to further enhance the versatility of the apparatus, the modules 30 are preferably relatively small and each may comprise a single pipe 31. Such small modules can be readily assembled into a practically infinite number of different shapes.

The manner in which the air issuing from or being fed to the blower is sterilized is known and forms no part of the invention.. The drawing further does not show the means for driving the motor of the blower and the means for reducing the pressure in opening or openings 15 below atmospheric pressure.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination with an operating table having a platform for supporting a patient, an apparatus for shielding the supported patient from germs and comprising:

blower means to one side of said platform having an upper outlet and spaced therebelow a lower outlet for discharging respective upper and lower discrete vertically spaced and generally parallel streams of sterilized air over said patient on said platform;

adjustment means on said blower means for changing the size and position of each of said outlets for varying the path of the respective air stream independently of the path of the other air stream; and suction means to the other side of said platform having an upper inlet and a lower inlet respectively aligned with said upper and lower outlets of said blower means for drawing in said streams after same have passed over said platform.

2. The apparatus defined in claim 1 wherein each of said outlets and each of said inlets is horizontally elongated, whereby said streams are horizontally oriented curtains.

3. The apparatus defined in claim 2 wherein said adjustment means comprises means for changing the cross-sectional area of said streams.

4. The apparatus defined in claim 2, wherein said adjustment means comprises means for changing the loci where said streams issue from said blower means.

5. The apparatus defined in claim 2 wherein said adjustment means comprises at least one shade on each of said outlets and movable between a plurality of positions to change the size of the respective outlet.

6. The apparatus defined in claim 2 wherein said adjustment means comprises a plurality of shades on each of said outlets and means for displacing same independently of one another to change the position of the respective outlet.

7. The apparatus defined in claim 2 wherein said blower means further comprises a casing and means for deforming said casing for changing said paths of said streams so that said paths pass over a patient supported on said platform.

8. The apparatus defined in claim 2 wherein said blower means further comprises a casing having a lower arcuate marginal portion near to and an upper arcuate marginal portion distant from said platform, said lower outlet being adjacent said lower marginal portion to discharge air forming said lower stream and said upper outlet being adjacent said upper marginal portion to discharge air forming said upper stream.

9. The apparatus defined in claim 8 wherein said casing and said marginal portions thereof are deformable and said adjustment means includes means for deforming said casing and said marginal portions for changing the shape of said outlets.

10. The apparatus defined in claim 2 wherein said blower means includes a deformable casing, said adjustment means including means for deforming said casing to change the paths of said streams, said suction means comprising a housing having said inlets and being deformable, said adjustment means including means for deforming said housing and aligning said inlets with said outlets.

11. The apparatus defined in claim 2 wherein said suction means has arcuate first and second marginal portions, said inlets being between said marginal portions.

12. The apparatus defined in claim 2 wherein said adjustment means has means for changing the size and position of each of said inlets.

13. The apparatus defined in claim 2 wherein said outlets are directed for convergence of the respective air streams, said suction means having a suction head located opposite said blower means.

14. The apparatus defined in claim 2 wherein said blower means comprises nozzles having orifices constituting said outlets.

15. The apparatus defined in claim 2 wherein said blower means comprises a plurality of modules each having a respective one of said outlets for sterilized air.

16. The apparatus defined in claim 15 wherein said modules are elongated.

17. The apparatus defined in claim 15 wherein said blower means comprises a plurality of nozzles having orifices which constitute said outlets.

18. The apparatus defined in claim 15 wherein said blower means comprises conduits in said modules and having air-discharging ends constituting said outlets.

19. The apparatus defined in claim 18 wherein each of said conduits has a nozzle constituting the respective air-discharging end.

20. The apparatus defined in claim 15 wherein said modules are independently displaceable.

21. The apparatus defined in claim 15 wherein said modules are deformable and said adjustment means includes means for deforming said modules.

22. The apparatus defined in claim 15 wherein said modules are identical and interchangeable.

23. The apparatus defined in claim 2, further comprising means for changing the orientation of said blower means with respect to said platform.

24. The apparatus defined in claim 2, further comprising means for supporting said suction means and including means for changing the orientation of said suction means with respect to said platform.

25. The apparatus defined in claim 2, further comprising means for changing the relative speed of said air streams independent of each other.

26. The apparatus defined in claim 2, further comprising a shroud intermediate said blower means and the nearest portion of said platform.

27. The apparatus defined in claim 26 wherein said shroud is deformable.

28. A method of preventing access of contaminants to an area having an operating table having a platform on which a medical operation is being carried out on a body part, said method comprising the steps of:

producing streams of sterile gas from shielding apparatus comprising blower means to one side of said platform having an upper outlet and spaced therebelow a lower outlet for discharging respective upper and lower discrete vertically spaced and generally parallel streams of sterilized air over said patient on said platform, adjustment means on said blower means for changing the size and position of each of said outlets for varying the path of the respective air stream independently of the path of the other air stream, and suction means to the other side of said platform having an upper inlet and a lower inlet respectively aligned with said upper and lower outlets of said blower means for drawing in said streams after same have passed over said platform;

directing said streams from said blower means of said apparatus to said suction means over said area with said streams passing tangentially over said body part; and aspirating said streams into said suction means, whereby said streams form a gas curtain tangenting said part.

29. The method defined in claim 28 wherein said streams are downwardly concave.

30. The method defined in claim 28 further comprising the step of imparting to each of said streams a shape seen in the direction of flow of the respective stream which corresponds to that of the body part.

31. The method defined in claim 28, further comprising the step of filtering the gas of said streams.

32. The method defined in claim 28, further comprising the step of recirculating the gas from said suction side to said blower side.

* * * * *